US007952602B2

(12) United States Patent
Govorkov et al.

(10) Patent No.: US 7,952,602 B2
(45) Date of Patent: May 31, 2011

(54) WIDE FIELD DIODE-LASER MARKER WITH SWINGING PROJECTION-OPTICS

(75) Inventors: Sergei V. Govorkov, Los Altos, CA (US); John H. Jerman, Palo Alto, CA (US)

(73) Assignee: Coherent, Inc., Santa Clara, CA (US)

( * ) Notice: Subject to any disclaimer, the term of this patent is extended or adjusted under 35 U.S.C. 154(b) by 585 days.

(21) Appl. No.: 12/233,026

(22) Filed: Sep. 18, 2008

(65) Prior Publication Data

US 2010/0053299 A1 Mar. 4, 2010

Related U.S. Application Data

(63) Continuation-in-part of application No. 12/202,604, filed on Sep. 2, 2008, now abandoned.

(51) Int. Cl.
*B41J 15/14* (2006.01)
*B41J 27/00* (2006.01)

(52) U.S. Cl. ..... 347/241; 347/256

(58) Field of Classification Search ..... 347/224, 347/225, 241–244, 256–260, 231
See application file for complete search history.

(56) References Cited

U.S. PATENT DOCUMENTS

| | | | | |
|---|---|---|---|---|
| 4,030,122 | A * | 6/1977 | Chemelli et al. | 386/230 |
| 4,602,858 | A | 7/1986 | Serge | 352/84 |
| 4,946,234 | A | 8/1990 | Sasada et al. | |
| 5,257,038 | A | 10/1993 | Ferschl et al. | 346/76 L |
| 5,303,081 | A | 4/1994 | Totsuka et al. | |
| 5,821,977 | A | 10/1998 | Nishimura | |
| 5,855,969 | A * | 1/1999 | Robertson | 427/555 |
| 6,075,759 | A * | 6/2000 | Yanagawa et al. | 369/44.18 |
| 6,335,824 | B1 * | 1/2002 | Overbeck | 359/368 |
| 6,404,313 | B2 | 6/2002 | Asada | |
| 6,489,985 | B1 | 12/2002 | Brodsky et al. | 347/247 |
| 6,676,878 | B2 | 1/2004 | O'Brien et al. | |
| 6,843,568 | B2 | 1/2005 | Schenk et al. | |
| 6,882,462 | B2 | 4/2005 | Helsel et al. | |
| 7,407,105 | B2 | 8/2008 | Massieu et al. | |
| 7,436,423 | B2 | 10/2008 | Mizuyama et al. | |
| 2004/0094728 | A1 | 5/2004 | Herzog et al. | |
| 2005/0269298 | A1 | 12/2005 | Hotta et al. | |
| 2006/0215138 | A1 | 9/2006 | Liu | |
| 2007/0268950 | A1 | 11/2007 | Spinelli et al. | |
| 2010/0078857 | A1 | 4/2010 | Govorkov et al. | |
| 2010/0079572 | A1 | 4/2010 | Govorkov et al. | |

OTHER PUBLICATIONS

Non Final Office Action received for U.S. Appl. No. 12/240,126, mailed on Jun. 15, 2010, 17 pages.

U.S. Appl. No. 12/202,604, filed Sep. 2, 2008, entitled "Wide Field Diode-Laser with Swinging Projection-Optics," by Sergei V. Govorkov et al, 17 pages in length.

(Continued)

*Primary Examiner* — Hai C Pham
(74) *Attorney, Agent, or Firm* — Morrison & Foerster LLP

(57) ABSTRACT

Apparatus for laser-marking on tape includes a laser arranged to emit a modulated beam of laser-radiation. Projection-optics are arranged to focus a beam to a spot on the tape. The tape is driven under the focal spot for scanning the beam in the length direction of the tape. The projection-optics are rotated reciprocally to scan the focal spot over the tape in a direction transverse to the length direction of the tape.

14 Claims, 4 Drawing Sheets

OTHER PUBLICATIONS

Final Office Action received for U.S. Appl. No. 12/240,126, mailed on Nov. 22, 2010, 13 pages.

Notice of Allowance received for U.S. Appl. No. 12/240,126, mailed on Feb. 18, 2011, 9 pages.

* cited by examiner

WIDE FIELD DIODE-LASER MARKER WITH SWINGING PROJECTION-OPTICS

CROSS-REFERENCE TO PRIOR APPLICATION

This application is a Continuation-in-Part of U.S. patent application Ser. No. 12/202,604, filed Sep. 2, 2008, now abandoned and assigned to the assignee of the present invention.

TECHNICAL FIELD OF THE INVENTION

The present invention relates in general to laser marking systems. The invention relates in particular to laser marking systems wherein the marking laser is a diode-laser.

DISCUSSION OF BACKGROUND ART

Laser marking systems are now in common use for marking materials such as metals, glass, wood, and plastic. Lasers used in such marking systems include diode-pumped solid-state lasers, fiber-lasers, and carbon dioxide ($CO_2$) lasers. Typically a beam from whatever is used in the system is steered by a two-axis galvanometer and focused by f-theta optics onto a surface of an object being marked.

Special materials have been developed, and are commercially available, for accepting laser radiation to allow high-speed, high-volume, writing of labels with a laser marking system. One such material is "Laser Markable Label Material 7847" available from 3M Corporation of Minneapolis, Minn. This material is a three-layer polymer material having a white base film with a black surface coating to facilitate absorption of laser radiation. The white base film becomes exposed when the black material is ablated away by laser radiation. The base film is backed by an adhesive layer. A paper liner supports the laminate which can be peeled off when the label is to be applied to the product. The white material can be laser-cut to define the bounds of the label and allow such peeling Even the least expensive laser marking system designed for this label material has a cost about two orders of magnitude greater than a computer peripheral paper-label printer such as an inkjet printer, which puts such a system beyond the means of the majority of householders or hobbyists. This is somewhat unfortunate as such a system does not require periodic replacement of inkjet or toner cartridges and will function until the laser eventually fails which may only be after tens of thousands of hours of actual use. There is a need for a significant reduction in the cost of laser marking systems for label printing and the like.

SUMMARY OF THE INVENTION

The present invention is directed to apparatus for marking on tape. In one aspect apparatus in accordance with the present invention comprises a laser arranged to emit a beam of laser-radiation. Projection-optics are arranged to focus the beam on the tape. One mechanical arrangement is provided for rotating the optics with the respect to the laser in a manner such that the focused beam is swept over the tape in a direction transverse to a length direction of the tape. Another mechanical arrangement is for driving the tape in the length direction thereof with respect to the focused beam such that the focused beam is moved over the tape parallel to the length direction thereof.

In one preferred embodiment of the inventive apparatus, the projection-optics are rotated in a plane perpendicular to the length direction of the tape. In other preferred embodiments of the apparatus, the projection-optics are rotated in a plane parallel to the length direction of the tape.

In one preferred embodiment, the laser is a diode laser. In other preferred embodiment, the laser is an optically pumped semiconductor laser. In the latter case, a lens is arranged to focus the beam into a beam waist in a beam-waist plane. The projection optics are arranged to project an image of the beam waist as a focal spot on the tape.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below, serve to explain principles of the present invention.

DETAILED DESCRIPTION OF THE INVENTION

Figure 1:
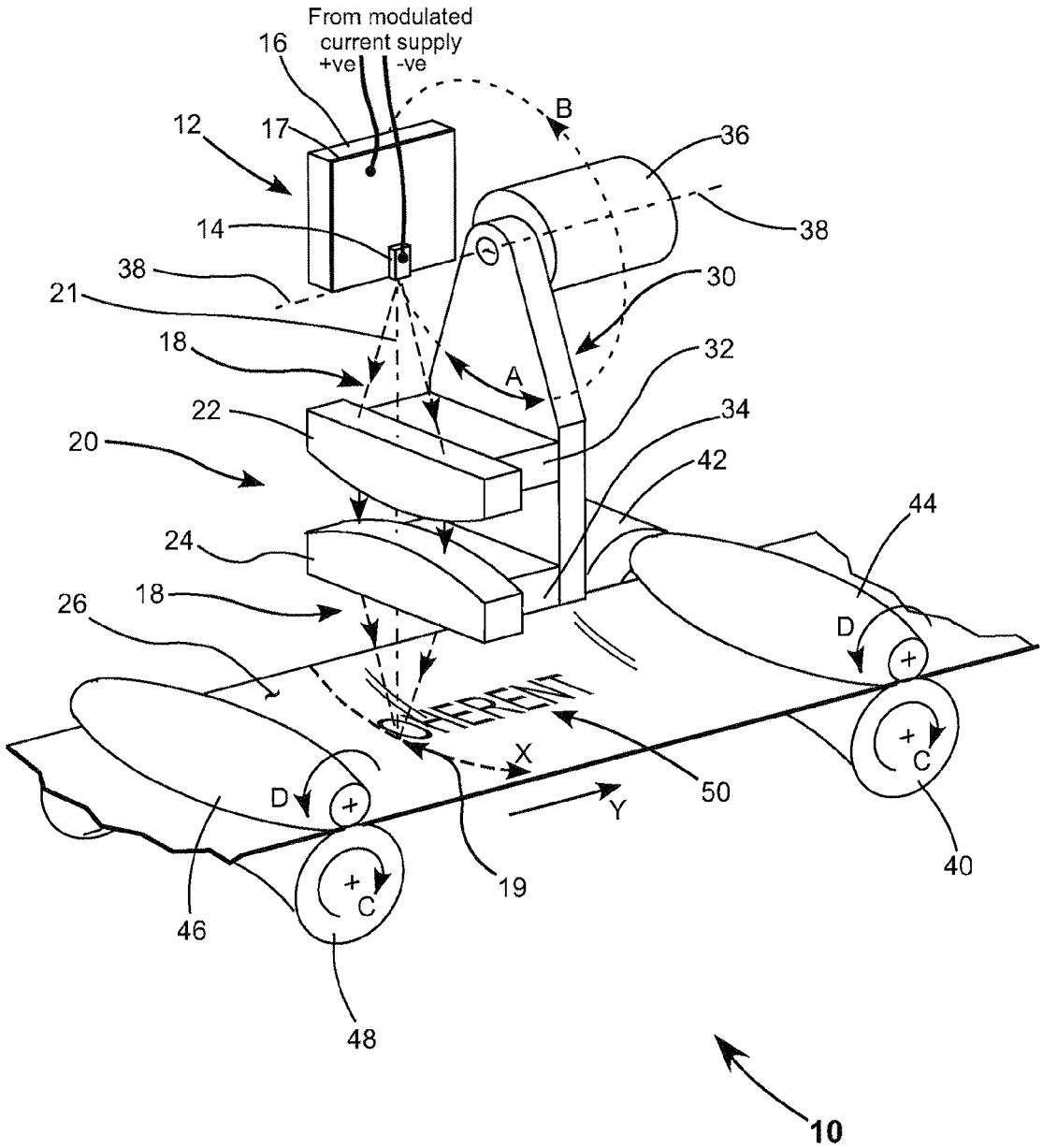
FIG. 1 is a three-dimensional view schematically illustrating one preferred embodiment of a laser marking apparatus in accordance with the present invention for marking a surface a material in tape form, the apparatus including a linear tape drive for feeding tape through the apparatus in one direction, a diode-laser for providing laser radiation, and projection-optics for focusing the laser radiation on the tape, the projection-optics arranged on a swinging arm to move periodically in an arcuate manner about an axis collinear with an emitting facet of the diode-laser and transverse to the drive direction of the tape, with the plane of the arcuate movement of the projection-optics being perpendicular to the drive-direction of the tape.

Referring now to the drawings, wherein like components are designated by like reference numerals, FIG. 1 schematically illustrates one preferred embodiment 10 of laser marking apparatus in accordance with the present invention. Apparatus 10 includes a diode-laser 12 including an edge-emitting semiconductor heterostructure (emitter) 14 on an insulating sub-mount 16. The sub-mount has a metallization layer 17 thereon to which the emitter is soldered. A heat-sink for cooling the sub-mount is preferably provided but is not shown, here, for simplicity of illustration.

Emitter 14 emits a beam 18 having a fast-axis divergence diverging in the fast axis of the emitter (as depicted) at an angle of about 30° measured across the FWHM intensity points of the beam. Divergence in the slow-axis (perpendicular to the fast axis and not depicted) is about 10°. These divergences should not be construed as limiting the present invention.

Beam 18 is intercepted by projection-optics 20 having an optic axis 21. Optics 20 include truncated plano-convex lenses 22 and 24. Optics 20 are arranged to focus beam 18 onto laser-radiation-receptive marking-material 26 in the form of tape.

Lenses 22 and 24 of optics 20 are mounted on an arm 30 via mounts 32 and 34 respectively. Arm 30 (and the optics thereon) are driven in an arcuate manner, by a DC motor 36, about an axis aligned with the slow-axis of emitter 14 at the emitting facet (not shown) thereof. The optics are preferably driven (swung) in a pendulum-like or oscillatory manner as indicated by arrow A such that optic axis 21 of the optics is swept periodically from adjacent one edge of tape 26 to the opposite edge and back. The swinging of the optics provides an X-axis scan of beam 18 as indicated by arrow X.

Tape 26 is in contact with a concave-curved roller 40 that is driven by a DC motor 42 to rotate in a clockwise direction as indicted by arrow C. Tape 26 is held in contact with roller 40 by an idler roller 44 having a convex curvature matching the concave curvature of roller 40. Rotation of roller 40 drives tape 26 in a direction indicated by arrow Y to provide the effect of a Y-axis scan of focal-point 19 of beam 18 on the tape. Roller 44 is caused, by Y-axis movement of tape 26, to turn in a counterclockwise direction as indicated by arrow D.

The curvature of rollers 40 and 44, co-operative with an essentially identical curvature of another pair of complementary-curved idler rollers 46 and 48, respectively, is selected such that the tape is forced into a concave (with respect to beam 18) curvature in the X-direction. The curvature of the tape has a radius equal to the distance of swing-axis 38 to the tape perpendicular to the Y-axis. This provides that the focus of beam 18 stays on the tape throughout the range of oscillatory motion of optics 20. In other words there is a focused image of the emitting facet of emitter 14 on the tape throughout the range of oscillatory motion of optics 20.

Diode-laser 14 is driven by current from a modulatable current supply. The modulation can be programmed, for example from a computer-generated bit-map image, in cooperation with the oscillation (swing) frequency of arm 30 and optics 20 thereon, and with the driving of the tape the Y-direction thereof, such that focused laser-beam 18 draws a mark 50 on the tape. The mark 50 can be a graphic design or may comprise alphanumeric characters as shown. It should be noted, here, that mark 50 is depicted as a black mark on a white background for convenience of illustration. Using multilayer tape described above, the mark would actually appear as a white mark on a black background.

Preferably tape 26 is preferably driven incrementally in the Y direction, being stationary while the focus of beam 18 is swept in one direction during, which sweep "pixels" of the mark are written to the tape, according to the modulation of diode-laser 14, constituting one "line" of pixels. No pixels are recorded during the return sweep of the beam and the tape is incremented in the Y-direction before the next line of pixels is written. This preferred operation of the apparatus should not be construed as limiting Those skilled in the art may operate the apparatus in other ways without departing from the spirit and scope of the present invention.

In a calculated example of apparatus 10, it was assumed that tape 26 was the 7847 tape discussed above, and that emitter 14 emitted between about 5.0 and 10.0 Watts (W) in a beam 18 having a fast-axis divergence (at FWHM) of about 29°. It was determined experimentally that maximum linear marking speed was about 500 millimeters per second (mm/sec). Lenses 22 and 24 were assumed to be an aspheric lens-pair available as part number AL3026 available from Thorlabs Inc., of Newton, N.J. Lens 22 collimates beam 18 from the diode-laser and lens 24 focuses the beam. Using this lens-pair as optics 20, the distance of the focus of optics 20 from the emitting facet of emitter 14, i.e., from swing axis 38 to the tape, would be about 120.0 mm. This exemplified lens-pair has a numerical aperture (NA) of 0.52 corresponding to an acceptance angle of 62° (FWHM). Given the fast-axis beam divergence of 29° this would provide that the axis 21 could swing ±16° about a vertical alignment at the center of the tape. This would correspond to a maximum marking width of about 67.0 mm, i.e., about 2.5 inches. The swing frequency would be about 4.0 Hertz (Hz). The focused beam had dimensions of between about 10 and 20 micrometers (μm) by about 90 μm generally, but not exactly, corresponding to the dimensions of the emitting area (facet) of the diode-laser. This translates to a marking resolution of about 250 dots per inch (dpi). Given these assumptions, it is estimated that about one-minute would be required to mark a label about 2.5 inches square. It should be noted here that the short-axis dimension of the focused beam is limited by the quality of imaging optics, as the emitting area of the diode-laser has a fast-axis height of only about 1.0 μm.

Regarding removal of a marked label from tape 26, one simple method would be to have stock-sized label shapes pre-cut in the tape in the manner in which adhesive-backed paper labels are formed in sheets on a suitable carrier (release) material. A more flexible method however, adaptable to the three-layer tape discussed above, would be to laser-cut a label outline through the first two layers of tape by operating apparatus 10 with the focus sweep rate in the X-axis slowed down. This could be done before or after the label was actually "written" or marked as described above. This would allow essentially any size or shape of label to be created that would fit within the sweep width of the focused beam.

It should be noted here that while the arcuate motion of arm 30 and optics 20 thereon is preferably a swinging (pendular or oscillatory), it is also possible, in theory at least, to provide that arm 30 is rotated in only one direction (indicated in FIG. 1 by arrowhead B), preferably with emitter 14 turned off when optic axis 21 is not traversing tape 26. Such a rotational arrangement may afford a wider choice of drive motor types for motor 36, however, at a disadvantage of the apparatus being usable for only about one-tenth the time required for a 360 rotation of the optics. Further, any housing in which the apparatus was located would need to have sufficient height to accommodate the optics at top-dead-center.

Figure 2:
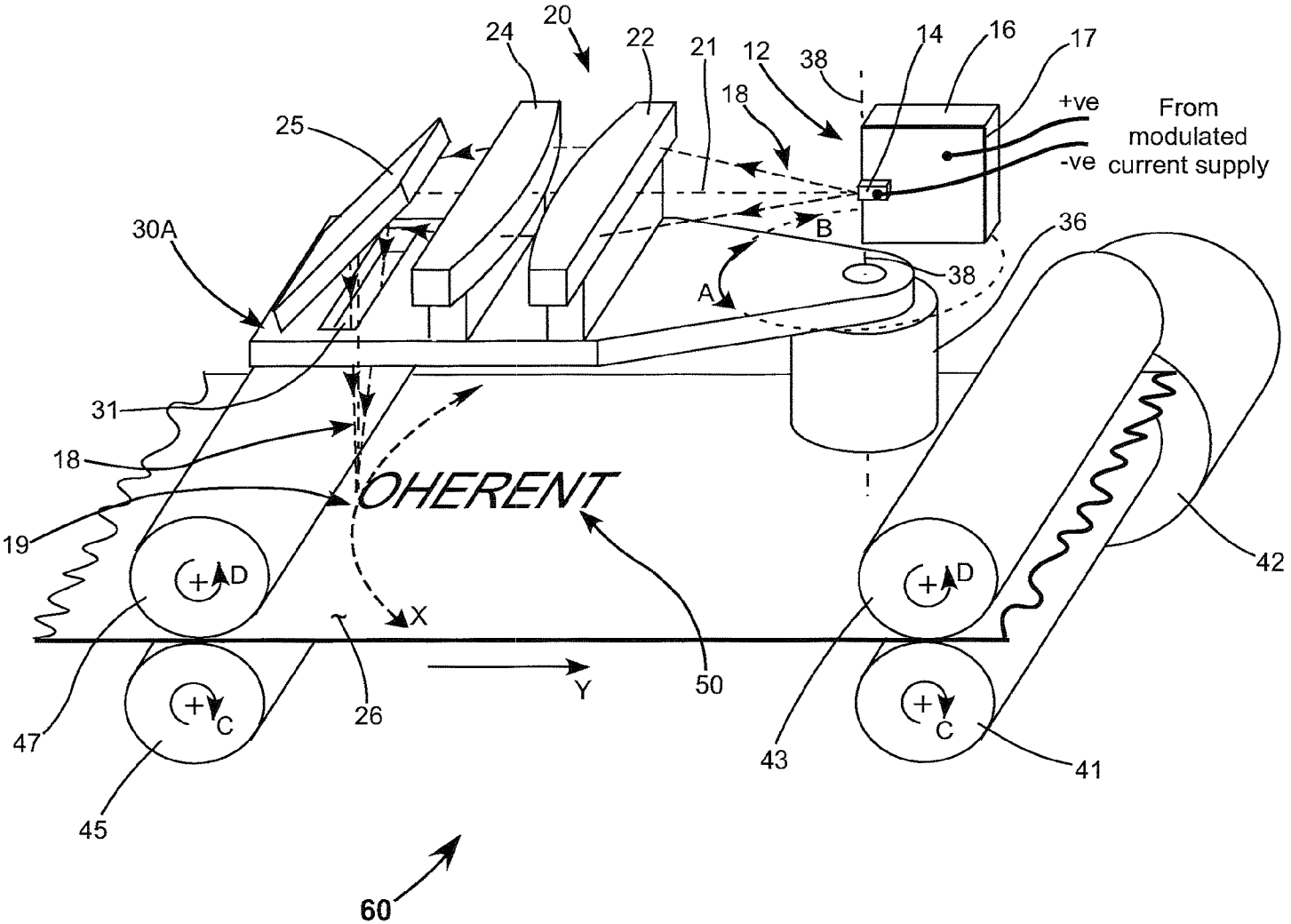
FIG. 2 schematically illustrates another preferred embodiment of a laser marking apparatus in accordance with the present invention, similar to the apparatus of FIG. 1 but wherein the plane of arcuate movement of the projection-optics is parallel to the drive direction of the tape, with a turning mirror being provided for directing radiation from the projection-optics onto the tape.

FIG. 2 schematically illustrates another embodiment 60 of laser-marking apparatus in accordance with the present invention. Apparatus 60 is similar to apparatus 10 of FIG. 1 with exceptions as follows.

In apparatus 60, curved rollers 40, 44, 46 and 48 are replaced with cylindrical rollers 41, 43, 45, and 47, respectively. DC-motor 42 drives roller 41 with all other rollers being idlers. The cylindrical rollers keep tape 26 flat while being driven by rotation of roller 41 in clockwise direction D. Diode-laser 12 is arranged still with the fast-axis thereof transverse to the direction (Y-direction) of the tape drive, but with emitter 14 emitting radiation in a direction parallel to the tape as opposed to perpendicular to the tape in apparatus 10.

Optics-mounting arm 30 of apparatus 10 is replaced with a longer arm 30A. Arm 30A and optics 20 thereon are "swung" about axis 38 in a plane parallel to the plane of the tape (as indicated by arrows A), rather than perpendicular to the tape as in apparatus 10. In apparatus 60 a turning mirror 25 inclined at 45 to optic axis 21 is located axially downstream of optics 20 and arranged to direct the beam being focused by the optics, through a rectangular aperture 31 in the arm, onto the tape in a direction perpendicular to the tape, to be focused thereon. As arm 30A is swung parallel to the plane of the tape, beam 18 is focused on the tape throughout the angular swing-range of the optics. This arrangement allows for a flatter packaging than the arrangement of apparatus 10, at the expense, inter alia, of a somewhat more complicated design for the swing arm. As in the case of apparatus 10, it is possible, with similar caveats, to rotate the optics arm and optics thereon continuously as indicated by arrow B.

In apparatus 30 it would be necessary when programming the modulated (modulatable) current supply for the diode-laser to transform a computer-generated bit-map image to compensate for the X-axis curvature on the tape. This would be a relatively simple transformation as each line of the image would have the same curvature.

Figure 3:
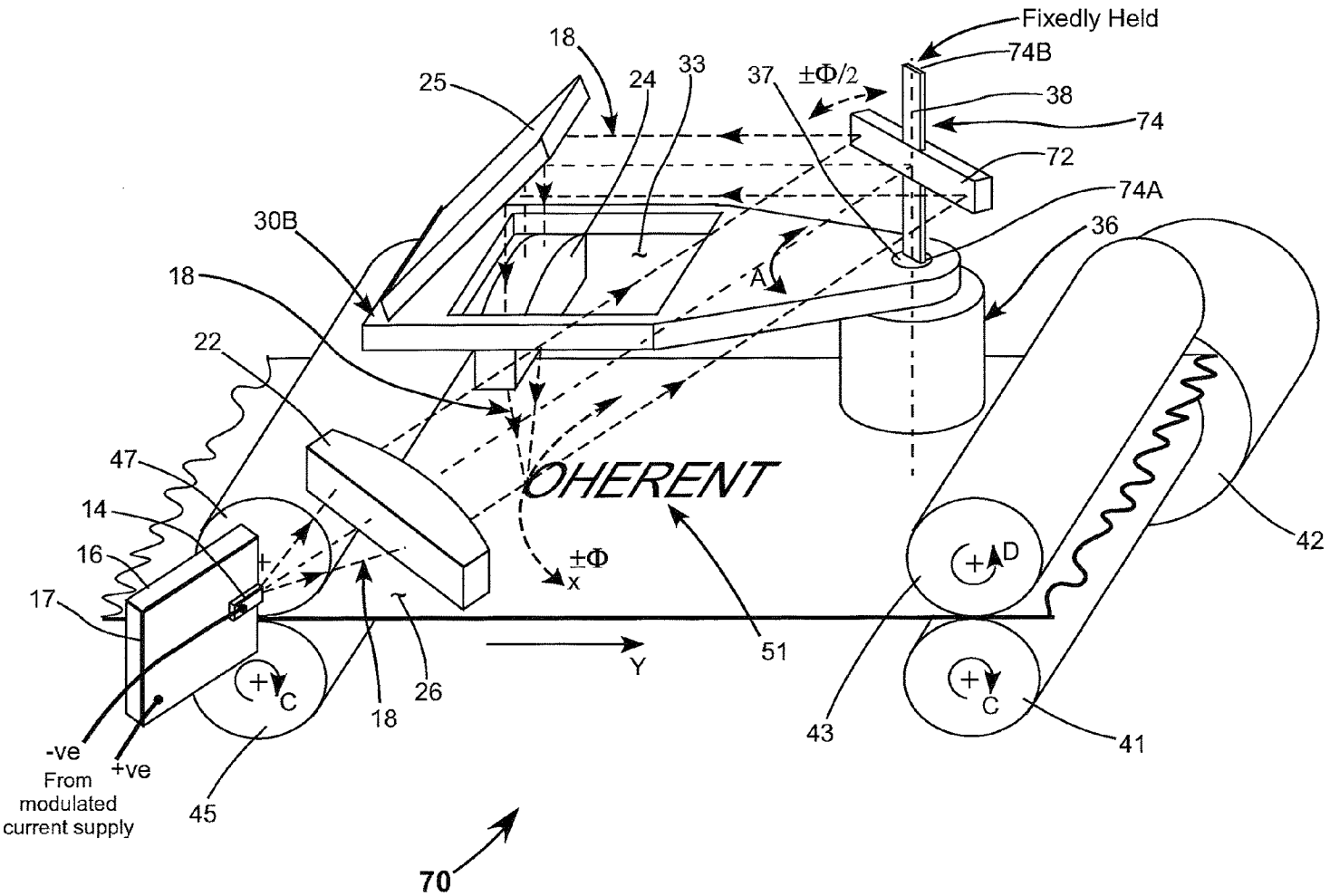
FIG. 3 schematically illustrates yet another preferred embodiment of a laser marking apparatus in accordance with the present invention, similar to the apparatus of FIG. 2 but wherein the projection-optics include a fixed collimating lens not on the swinging arm and a focusing lens on the swinging arm with a turning mirror on the swinging arm arranged to oscillate at one-half of the angular oscillation rate of the swinging arm.

FIG. 3 schematically illustrates yet another preferred embodiment 70 of a laser marking apparatus in accordance with the present invention. Apparatus 70 is similar to the apparatus 60 of FIG. 2 with exceptions as follows. In apparatus 70 the load on swinging arm 30B is lightened by removing lens 22 from the arm and placing that lens in a fixed relationship with diode-laser 14. This allows swinging arm 30B to itself to be lightened by comparison with arm 30A of laser 60, here by providing an enlarged aperture 33 in the arm.

Beam 18 from diode-laser 14 is collimated by lens 22 and directed to a turning mirror 72 which is attached to a torsion beam 74. Mirror 72 directs the collimated beam, parallel to the Y-drive direction of tape 26, onto turning mirror 25. Turning mirror 25 directs the collimated beam onto focusing lens 24, which is suspended from arm 30B below aperture 33 therein. Lens 24 focuses the collimated beam onto tape 26.

The focus spot is swept across the tape by oscillating arm 30B as indicated by arrow A. This causes the focus spot to sweep through an angle of $\pm\Phi$, on tape 26, with respect to axis 38 of drive-motor 36.

In order to maintain collimated beam 18 aligned with mirror 25 and lens 24, mirror 72 must be swept through only $\pm\Phi/2$ in response to the oscillation of arm 30B since the angular sweep of the beam off mirror 72 is $2\Phi$ (in increase in the angle of incidence also increase the angle of reflection). Compensation is accomplished as follows. One end 74A of beam 74 is attached to drive-shaft 37 of motor 36. An opposite end 74B of beam 74 is fixedly held by a bracket or the like (not shown). As arm 30B is oscillated beam 74 will be twisted, with end 74A of the beam twisting reciprocally through an angle of $\pm\Phi$ with respect to fixed end 74B of the beam. Mirror 72 is mounted half-way between ends 74A and 74B of the beam. As a result mirror twists at only one-half the angular rate of the oscillation of arm 30B. Accordingly mirror 72 sweeps through an angle of $\pm\Phi/2$ in response to sweeping arm 30B through $\pm\Phi$, whatever the amplitude of $\Phi$.

Figure 4:
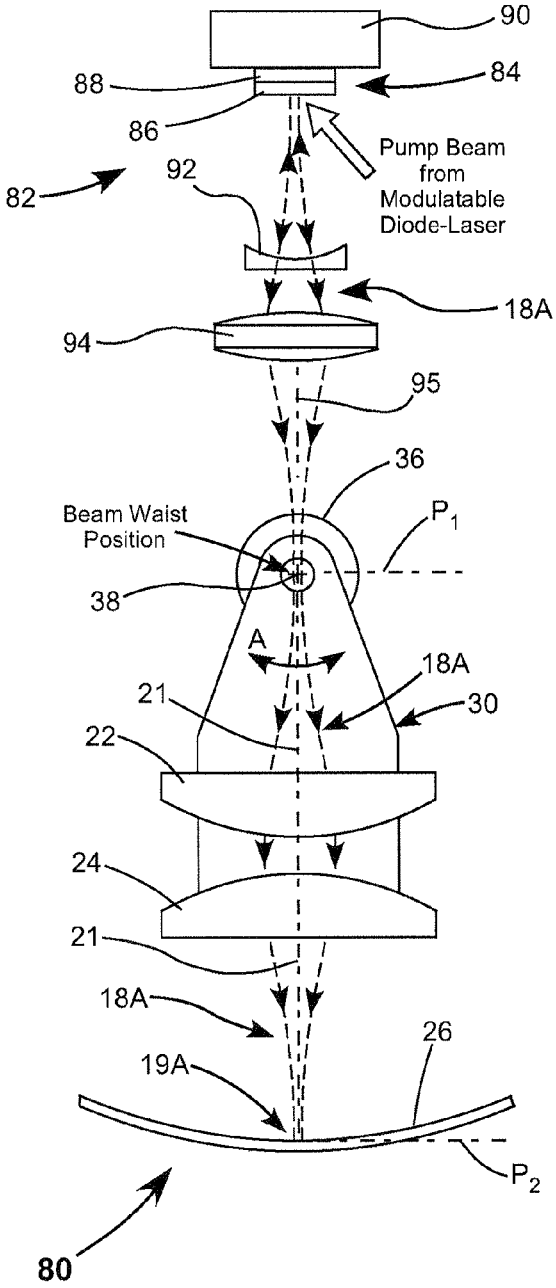
FIG. 4 schematically illustrates still another preferred embodiment of a laser marking apparatus in accordance with the present invention, similar to the apparatus of FIG. 1 but wherein the diode-laser is replaced by an external cavity optically-pumped surface-emitting semiconductor laser.
Figure 4A:
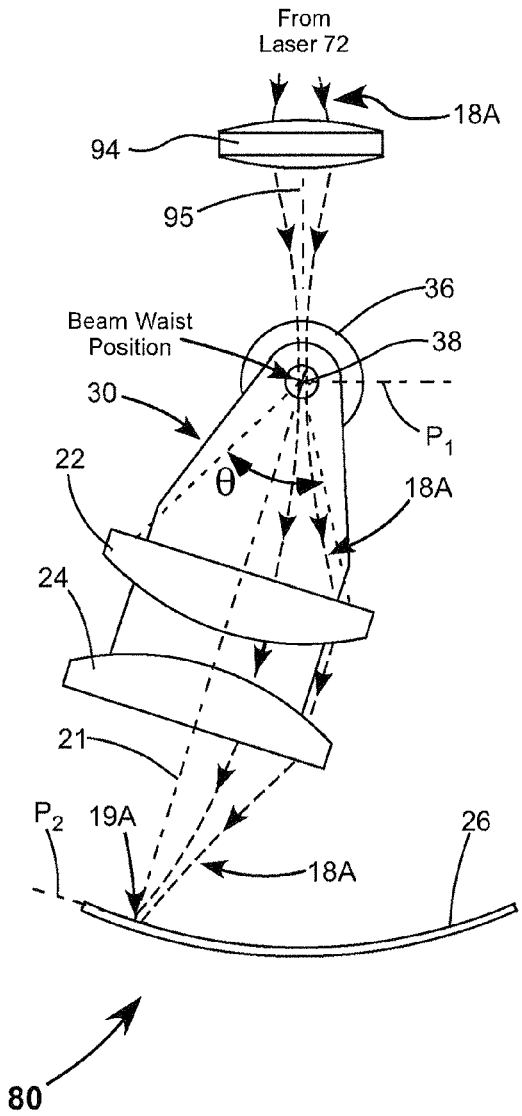
FIG. 4A schematically illustrates further detail of the apparatus of FIG. 4A.

FIG. 4 and FIG. 4A schematically illustrate still another embodiment 80 of laser marking apparatus in accordance with the present invention. Apparatus 80 is similar to apparatus 10 of FIG. 1 with an exception that diode-laser (edge-emitting semiconductor laser) assembly 12 of apparatus 10 is replaced in apparatus 80 by an optically-pumped (diode-laser pumped) external-cavity surface-emitting semiconductor laser 82, hereinafter referred to simply as an OPS-laser.

Referring first to FIG. 4, OPS laser 82 includes an OPS-chip 84 having a multilayer semiconductor gain-structure 86 surmounting a mirror structure 88. OPS-chip 84 is supported on a heat-sink 90. A stable laser-resonator is formed between mirror-structure 88 and a concave out-coupling mirror 92 from which a beam 18A is delivered. Output beam 18A is modulated, for above-described marking, by modulating a diode-laser source (not explicitly shown) that delivers pump radiation to gain-structure 86.

Unlike the poor-quality astigmatic-beam, having different fast-axis and slow-axis divergence, delivered by a diode-laser, beam 18A has the same divergence in each transverse axis and can have a very high beam quality, for example $M^2$ as low as about 1.1. Further detailed description of an OPS-laser is not necessary for understanding principles of the present invention, and, accordingly, such a detailed description is not presented herein. A detailed description of OPS-lasers is provided in U.S. Pat. No. 6,097,742, assigned to the assignee of the present invention, and the complete disclosure of which is hereby incorporated by reference.

Beam 18A from OPS-laser 82 is focused by a lens 94 to provide-waist position in a beam-waist plane P1 which is arranged to be coincident with rotation-axis 38 of arm 30. The beam diverges past the beam waist plane and is intercepted and collimated by lens 22. The collimated beam is intercepted by lens 24 which focuses the beam into focal spot 19A on tape 26, in a plane $P_2$ which can be regarded as an image plane of beam-waist plane $P_1$.

In FIG. 4 arm 30 is positioned such that optic axis 21 of lenses 22 and 24 is aligned with axis 95 of lens 94. Axis 95, here, corresponds to the propagation axis of beam 18A leaving lens 94. In FIG. 4A, arm 30 is positioned near an extremity of a swing arc such that the entire width of beam 18A is incident on lens 22 to one side of axis 21. However as the beam lies within an acceptance angle theta ($\theta$) of lens 22, the beam is collimated by lens 22, and the collimated beam is focused into focal spot 19A aligned with axis 21 of lenses 22 and 24. Accordingly focal spot 19A is swept back and forth across the tape as arm 30 is swung back and forth (oscillated in pendulum fashion) as indicated by arrow A in a manner similar to that in which focal spot 19 is swept across the tape in apparatus 10. Plane P2 is perpendicular to axis 21 and tangential to the surface of tape 26 through the swing-arc of arm 30.

One reason that OPS-lasers and a diode-laser are particularly preferred as light sources for apparatus in accordance with the present invention is that both can be modulated at a very high rate, for example about 10 megahertz (MHz) or greater. This allows the raster marking method of the apparatus to print a label in a practical time-period. Most solid-state and fiber lasers can not be modulated at such a rate and are suitable primarily for printing apparatus in which vector marking is used. The vector method required the use of two-axis galvanometers, which add considerably to the cost of the apparatus.

While an OPS-laser is described in the context of a replacement for diode-laser 12 in apparatus 10 of FIG. 1, those skilled in the art will recognize from the description provided above, without further detailed description or illustration, that the OPS-laser could replace the diode-laser in apparatus 60 of FIG. 2 and apparatus 70 of FIG. 3. By way of example, in apparatus 60 the OPS-laser and lens 94 would be arranged such that axis 95 of the lens were parallel to the plane of tape 26 with the beam waist plane aligned with rotation-axis 38 of arm 30A. In apparatus 70 focusing lens 94 for the OPS-beam would be replaced by a lens arranged to collimate the beam from the OPS-laser with the collimated beam being directed onto scanning mirror 72 with the axis of the collimated beam aligned with and perpendicular to rotation-axis 38 of the scanning mirror. Those skilled in that art will recognize that other laser-sources may be used in the above-described and other embodiments of the apparatus without departing from the spirit and scope of the present invention.

In summary, the present invention is described above in terms of a preferred and other embodiments. The invention is not limited, however, to the embodiments described and depicted. Rather, the invention is limited only by the claims appended hereto.

What is claimed is:

1. Apparatus for marking on tape, comprising:

a laser arranged to emit a beam of laser radiation;

projection optics arranged to focus the beam to a focal point of the projection optics on the tape, wherein the projection optics include a first lens arranged to collimate the beam of laser radiation from the laser and a second lens arranged to focus the collimated beam;

an arrangement for rotating at least a part of the projection optics arrangement with the respect to the laser in a manner such that the focal point is swept generally transverse to a length direction of the tape; and a mechanical arrangement for driving the tape in the length direction thereof with respect to the focused beam, such that the focal point moves over the tape about parallel to the length direction thereof and wherein the first lens is held in a fixed relationship with the laser, wherein the projection optics further includes first and second turning mirrors, the second turning mirror and the second lens being mounted on a support member rotatable reciprocally in a plane parallel to the length direction of the tape about an axis spaced apart from the laser, wherein the first turning mirror of the projection optics is arranged to receive the collimated bean from the first lens and to maintain the collimated beam directed to the second turning mirror, wherein the second turning mirror is arranged to direct the collimated beam to the second lens in a direction about perpendicular to the plane of rotation of the support member, and wherein the second lens is arranged to focus the collimated beam to the focal point on the tape and wherein the support member is rotated about the rotation axis at a first angular rate and maintenance of the collimated beam directed to the second turning mirror is accomplished by rotating the second turning mirror about the rotation axis at a second angular rate, with the second angular rate being about one-half of the first angular rate.

2. The apparatus of claim 1, wherein the tape has a width, and the projection optics arrangement is rotated reciprocally about a rotation axis such that the focal point sweeps reciprocally over the tape within the width of the tape.

3. The apparatus of claim 2, wherein the mechanical arrangement for driving the tape includes rollers arranged to hold a surface of the tape being marked about parallel to the plane through which the projection optics rotates.

4. The apparatus of claim 1, wherein the support member is rotated by a drive shaft having a rotation axis corresponding to the rotation axis of the support member, wherein the first turning mirror is mounted on an elongated torsion member having a length and first and second ends, and wherein the first end of the torsion member is attached to the drive shaft, the second end of the torsion member is fixedly held, and the first turning mirror is mounted on the torsion member about mid way between the first and second ends thereof, whereby rotation of the drive shaft at the first angular rate causes rotation of the first turning mirror at the second angular rate.

5. The apparatus of claim 1, wherein a mechanical arrangement for driving the tape in the length direction thereof with respect to the focused beam, is arranged to move the tape incrementally.

6. An apparatus for marking a strip having a width and an extended length comprising:

means for translating the strip in a direction parallel to the length thereof;

a laser generating a modulated beam;

at least two lenses for collimating and focusing the beam onto the strip; and an arm carrying at least one of said lenses, said arm being rotatable in a plane parallel to the width of the strip so the angle and position which the beam enters said one lens is varied causing a focused beam spot to scan across the strip in a direction parallel to the width of the strip and wherein said arm caries first and second turning mirrors for directing the beam into said at least one lens and wherein said arm is coupled to a drive shaft of a motor and wherein said first turning mirror is mounted to an elongated torsion beam coupled to the drive shaft and wherein the opposite end of the torsion beam is fixed so that said opposite end does not rotate causing the torsion beam to twist during oscillation of the arm so that the angular rate of rotation of the first turning mirror is about half the angular rate of rotation of the arm.

7. An apparatus as recited in claim 6, wherein the arm oscillates in a back and forth manner to an extent that the focused beam spot scans across at least a majority of the entire width of the strip.

8. An apparatus as recited in claim 6, wherein the laser is a diode laser.

9. An apparatus as recited in claim 6, wherein the laser is an optically pumped semiconductor laser.

10. An apparatus as recited in claim 9, further including optics for focusing the beam emitted from the laser to a beam waist location and wherein said lenses function to project an image of the beam waist as a focal spot on the strip.

11. An apparatus for marking a strip having a width and an extended length comprising:

means for translating the strip in a direction parallel to the length thereof;

a laser generating a modulated beam;

at least two lenses for collimating and focusing the beam onto the strip;

an arm carrying one of said lenses, said arm being rotatable in a plane parallel to the length of the strip; and first and second turning mirrors carried by the arm for redirecting the beam into said one lens and towards the strip, with the rotation of the arm causing the angle and position which the beam enters said one lens to vary, such that a focused beam spot is caused to scan across the strip in a direction parallel to the width of the strip and wherein the arm oscillates in a back and forth manner to an extent that the focused beam spot scans across at least a majority of the entire width of the strip and wherein said arm is coupled to a drive shaft of a motor and wherein said first turning mirror is mounted to an elongated torsion beam coupled to the drive shaft and wherein the opposite end of the torsion beam is fixed so that said opposite end does not rotate causing the torsion beam to twist during oscillation of the arm so that the angular rate of rotation of the first turning mirror is about half the angular rate of rotation of the arm.

12. An apparatus as recited in claim 11, wherein said second turning mirror is positioned to receive the beam reflected from the first turning mirror and redirect the beam into said one lens.

13. An apparatus as recited in claim 12, wherein the other lens is independently mounted separate from the arm and positioned between the laser and the first turning mirror.

14. An apparatus as recited in claim 11, wherein the laser is an optically pumped semiconductor laser.

* * * * *